United States Patent [19]

Hudson, Jr.

[11] Patent Number: 4,798,187

[45] Date of Patent: Jan. 17, 1989

[54] LOW PROFILE FUEL INJECTION RAIL

[75] Inventor: Sharon J. Hudson, Jr., Lambertville, Mich.

[73] Assignee: Sharon Manufacturing Company, Lambertville, Mich.

[21] Appl. No.: 928,046

[22] Filed: Nov. 7, 1986

[51] Int. Cl.[4] ..... F02M 55/02

[52] U.S. Cl. ..... 123/469; 123/470; 123/447

[58] Field of Search ..... 123/468, 469, 470, 472, 123/467, 463, 447; 239/550, 600

[56] References Cited

U.S. PATENT DOCUMENTS

| | | | |
|---|---|---|---|
| 4,286,563 | 9/1981 | Fahim et al. | 123/469 |
| 4,307,693 | 12/1981 | Glöckler et al. | 123/470 |
| 4,457,280 | 7/1984 | Hudson, Jr. | 123/468 X |
| 4,474,160 | 10/1984 | Gartner | 123/468 |
| 4,519,368 | 5/1985 | Hudson, Jr. | 123/470 X |
| 4,601,275 | 7/1986 | Weinland | 123/516 X |
| 4,649,884 | 3/1987 | Tuckey | 123/470 X |
| 4,660,524 | 4/1987 | Bertsch et al. | 123/468 |

FOREIGN PATENT DOCUMENTS

| | | | |
|---|---|---|---|
| 2024937 | 1/1980 | United Kingdom | 123/468 |

*Primary Examiner*—Ira S. Lazarus
*Assistant Examiner*—R. R. Cole
*Attorney, Agent, or Firm*—Harold F. Mensing

[57] ABSTRACT

A low profile fuel injection rail assembly for supplying fuel to a plurality of electromagnetic fuel injectors on an internal combustion engine. The fuel rail assembly is characterized by a plurality of fuel sump chambers defined by linearly spaced apart nodular rail sections which are connected in series by a plurality of tubular rail sections having cross sectional openings of reduced size. A recessed socket which embraces an end of a fuel injector and has an aperture for supplying fuel thereto is formed in each sump chamber.

16 Claims, 6 Drawing Sheets

LOW PROFILE FUEL INJECTION RAIL

BACKGROUND OF THE INVENTION

1. FIELD OF THE INVENTION

This invention relates to a tubular fuel rail for supplying fuel to a plurality of electromagnetic fuel injectors for a multicylinder internal combustion engine. More specifically it relates to a fuel rail having a plurality of spaced apart bulbous or nodular sections defining fuel sumps which contain recessed sockets. Fuel is supplied to the fuel injectors through apertures in the sockets. The fuel sumps are connected together in series by tubular arteries or ducts having cross sectional openings of reduced size.

2. DESCRIPTION OF THE PRIOR ART

Prior art fuel rails may have functioned acceptably but many were made up of a large number of separate parts. The large number of parts resulted in unnecessary manufacturing costs and difficulties, particularly in placing the parts in their relative positions and integrally connecting and sealing the parts together. Some of the early fuel rails were bulky and interferred with access to the injectors or to adjacent parts. Occasionally audible noise would develop as a result of a resonant interaction caused by the timed movement of fuel into the injectors. Another problem which may be related to resonance was that injector outputs varied depending upon the location of the injector. Apparently turbulence or some other unexplained internal factor affected the distribution of fuel to the separate injector sites and caused this lack of uniformity. In some prior art fuel rails the injector sockets were located below the fuel in the body of the fuel rail and thus water and dirt could easily gravitate directly into the top of the injector sockets and be inducted into the injectors.

The invention disclosed herein solves a number of these problems by forming the injector sockets directly in the bottom half of the fuel rail. The sockets are recessed into the rail rather than projecting below it. This allows for a reduction in the height of the rail. The bulbous sump chamber sections appear to dampen or attenuate noise impulses produced by the pulsed flow of fuel into the injectors. The combination of bulbous sump sections connected by narrow tubular arteries appears to prevent resonant noise buildup from one sump to another. This combination also provides a marked improvement in injector output uniformity. An annular portion of the sump chamber surrounding the bottom of each injector socket provides a depression for collecting any water or dirt particles that accidently enters the fuel rail.

SUMMARY OF THE INVENTION

The improved fuel injection rail assembly of this invention is a low profile type wherein the sockets for holding the head ends of the fuel injectors are each recessed into the body of the rail. To accomodate the recessed sockets and to provide a fuel sump chamber which surrounds its top and sides the portion of the rail adjoining each socket is enlarged. The bulbous or nodular sections defining the fuel sump chambers are connected in series by relatively narrow fuel arteries or tubular sections. In a preferred embodiment the fuel rail is comprised of an elongated bottom or base member with upturned sides and a mating cover member with downturned sides. The sides of one member overlap the sides of the other to provide a peripheral seam which is made fluid tight by bonding the overlapping sides together. A fuel pressure regulator mounting plate is integrally attached to the fuel rail adjacent to one end. Appropriate fuel supply, fuel return and fuel crossover filments are provided along with other mounting brackets and supports.

The details and advantages of the invention will be understood best if the written description is read with reference to the accompanying drawings.

DESCRIPTION OF THE PREFERRED EMBODIMENTS

Figure 3:
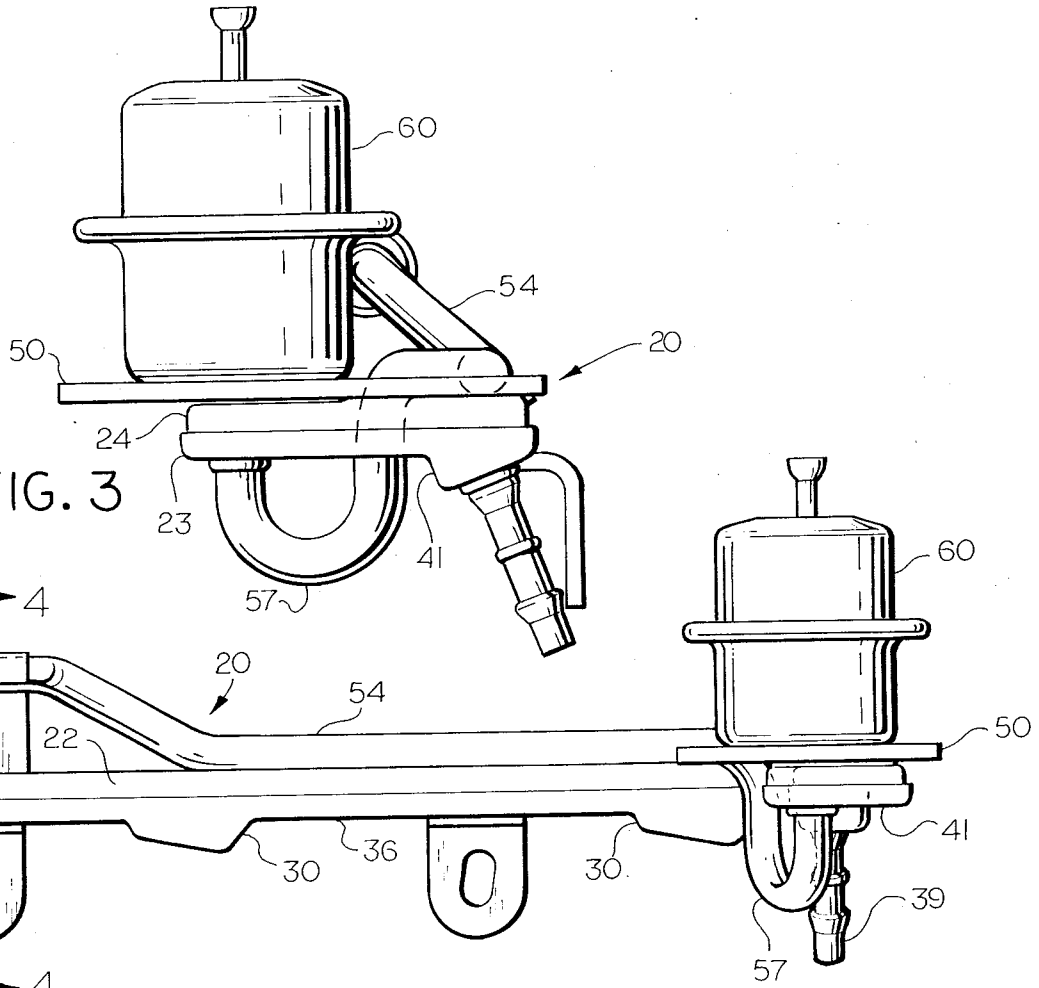
FIG. 3 is an end view of FIG. 1.

Referring to the drawings it will be noted that two fuel injection rail assembly embodiments, adapted for use on V-6 engines, are illustrated in the drawings. Each embodiment includes a pair of fuel injection rail assemblies, one for each bank of cylinders. Many of the elements are similar in structure or function so for the sake of brevity and for ease of understanding one fuel rail assembly of the first pair shown will be described in detail along with its component parts, while the remaining fuel rail assemblies and their component parts will be described in detail only in so far as they differ. Wherever possible similar components will be given similar reference numerals. It is to be understood that the teachings disclosed herein are not limited to fuel injection systems for V-6 engines but can be adapted to engines having more or fewer cylinders including engines wherein the cylinders are arranged in a single row.

The fuel injection rail assembly 20 illustrated in FIGS. 1–6 has a tubular fuel rail beam 22 comprised of an elongated base member 23 and a matching cover member 24. Preferably the members are formed from sheet metal by stamping processes. The base member 23 has an upturned peripheral wall 25 which overlaps a corresponding downturned peripheral wall 26 of the cover member 24. This overlapping relationship could be reversed so that the peripheral wall 26 is on the outside and thus provides a downwardly facing edge on the outside rather than an upwardly facing one. The downwardly facing edge is less likely to trap road dust. In either case the overlapping walls 25, 26 are bonded together, such as by furnace brazing to form a liquid tight seam extending around the longitudinal perimeter of the fuel rail beam 22.

The fuel rail beam 22 has a plurality of spaced apart bulbous or nodular sections 30 each of which defines a fuel sump chamber 32. The bottom or belly portion of each sump chamber 32 is formed in the base member 23. Preferably it extends below the adjacent rail beam surfaces and its sidewall converges downwardly to the open end of an injector cup socket 33 where the sump sidewall merges with the injector cup sidewall. The tapered outer wall provides for close coupling between a fuel injector 35 and the rail yet allows easy access to an electrical connector 37 of the fuel injector normally found near its top. The injector cup socket 33 has a cylindrical body with a radiused edge on its open bottom end and a fuel supply outlet aperture 34 in the center of its otherwise closed top end (see FIG. 6). The aperture 34 has a diameter slightly larger than the diameter of the circular top portion of the injector located above the O-ring seal. The cylindrical axes of the injector sockets 33 may be canted towards one end of the rail beam 22 and lie in a plane passing vertically through the longitudinal axis of the rail beam.

The nodular sections 30 of the rail beam are connected in series by narrow fuel arteries or tube sections 36. The portions of cover member 26 which define the upper halves of the tube sections have inverted U-shaped cross sections as can be seen best in FIG. 4. The mating base member portions have planar bottoms with upturned parallel sides. Preferably the bottoms of the tube sections 36 are located at a level that is above the bottom of the sump chambers 32 but below the tops of the injector sockets 33.

Various fitments are incorporated in the ends of the fuel rails to provide a flow of fuel into and out of them. For example, the fuel rail assembly 20 in FIGS. 1—6, for one bank of three cylinders of a V-6 engine, is designed to be coupled to the fuel rail assembly 120 (FIGS. 7—10), for the opposite bank of cylinders by means of elastomeric crossover hoses (not shown). Accordingly crossover hose connectors 38, 39, 138, 139 are provided at the respective ends of fuel rail assemblies 20 and 120. These connectors are located in stub end sections 40, 41, 140, 141 which extend outwardly from the first and last nodular sections 30, 130, of fuel rail beams 22, 122. The cross sectional size of the stub end sections is intermediate that of the tube sections 36, 136 and nodular section 30, 130. Each of the connectors is mounted in an aperture in a small flat surface found in the bottom panel of base member 23, 123. The flat surface is canted so that the longitudinal axis of the connector is tilted towards the opposite rail assembly (see FIGS. 3, 5, 9, 10).

Figure 1:
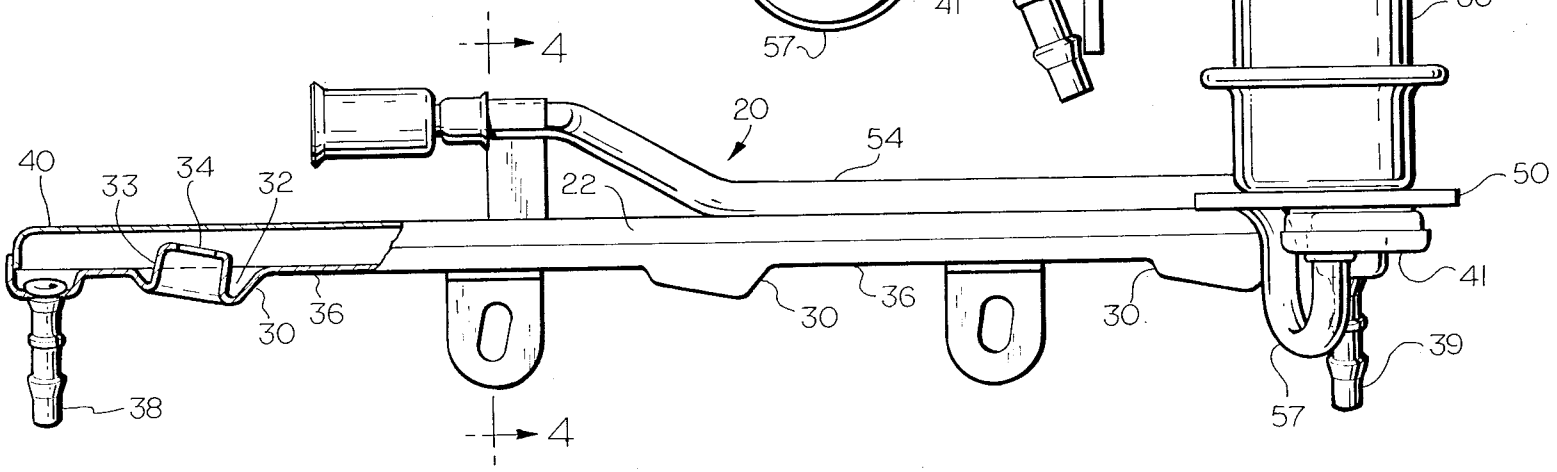
FIG. 1 is an outer side view of one of a pair of fuel rail assemblies for a V-6 engine with a portion of the assembly broken away to show the interior of one end and with a pressure regulator mounted on the other end.
Figure 4:
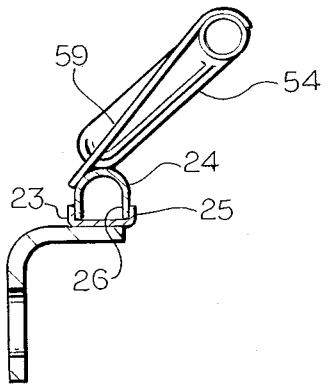
FIG. 4 is a cross sectional view taken along lines 4—4 of FIG. 1.
Figure 5:
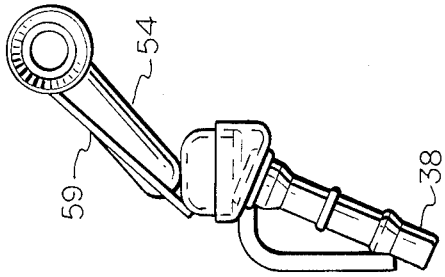
FIG. 5 is an end view opposite that of FIG. 3.
Figure 6:
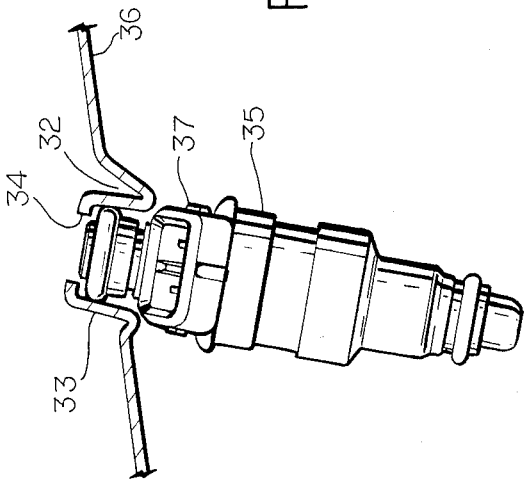
FIG. 6 is an enlarged sectional view of a broken away portion of a nodular section showing a fuel injector inserted in a socket.
Figure 2:
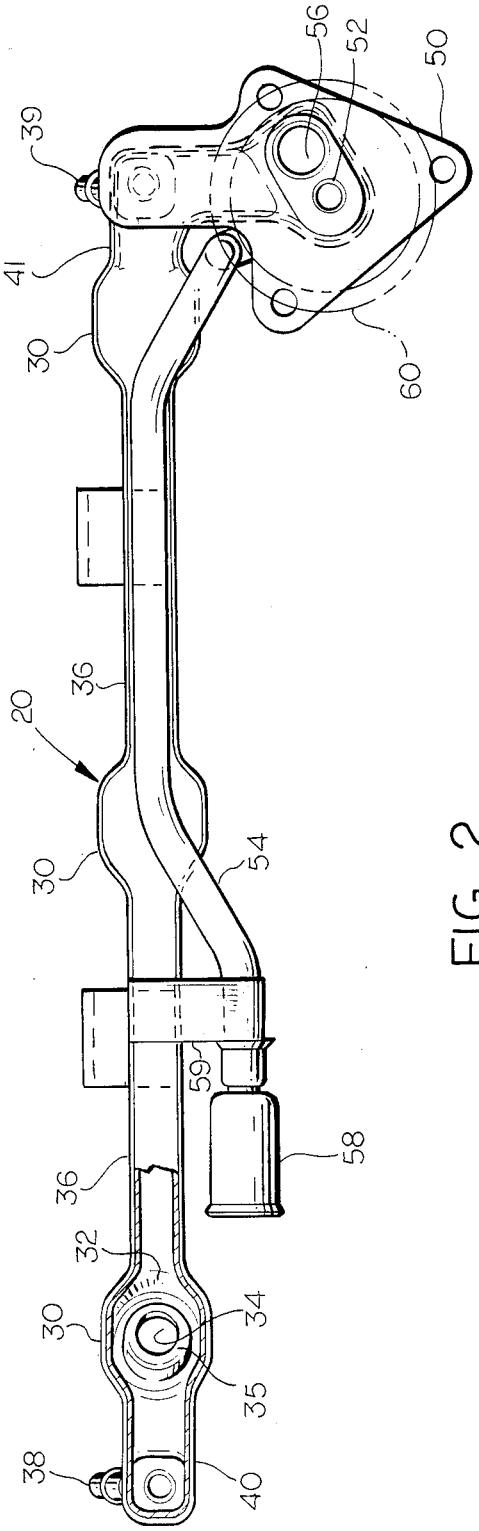
FIG. 2 is a plan view of FIG. 1 with the pressure regulator being illustrated in phantom lines to show details of its mounting plate.

One of the fuel rail assemblies of the pair has a pressure regulator mounting plate 50 affixed to the top of cover member 24 over its respective stub end section 41 (see FIGS. 1—3). Stub section 41 has a lateral leg with a small aperture 52 that contains the receiving end of a fuel return line 54 and a large aperture 56 in pressure communication with the fuel inside the rail 20. The fuel return line 54 extends downwardly from the pressure regulator mounting plate through the tubular stub section to a gooseneck section 57 whereupon it follows along the top of the rail beam to an offset and then terminates with a fuel line connector socket 58 adjacent to the end of the beam opposite from the regulator end. A supporting strap 59 extends downwardly at an angle from the end of the return line to the cover member where it is affixed. The pressure regulator 60 shown in full lines in FIGS. 1 and 3 and in phantom lines in FIG. 2 is a state of the art regulator.

Figure 9:
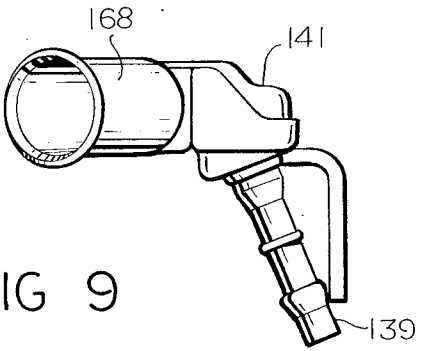
FIG. 9 is an end view of FIG. 7.
Figure 10:
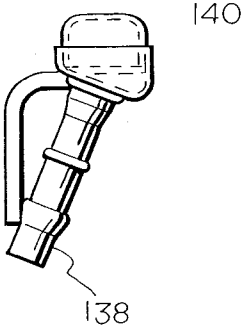
FIG. 10 is an end view opposite that of FIG. 9.
Figure 8:
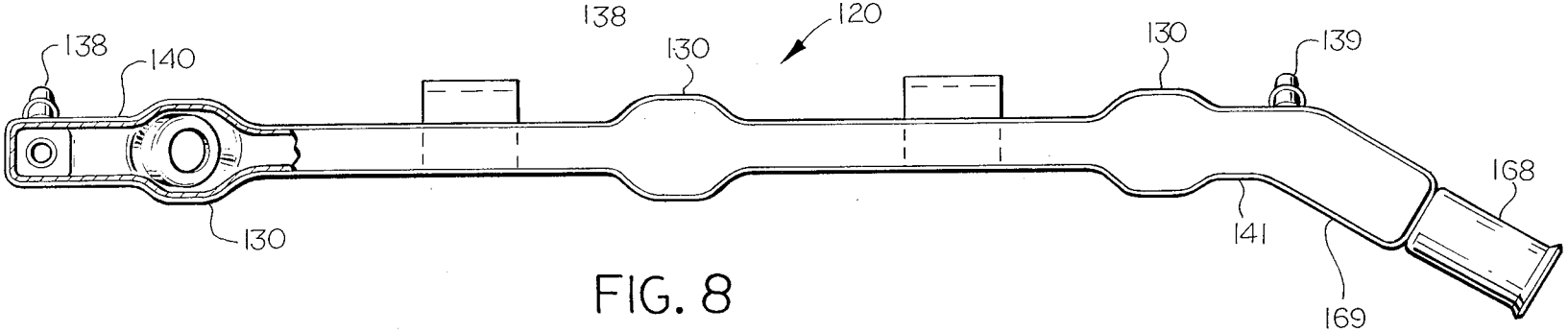
FIG. 8 is a plan view of FIG. 7.
Figure 7:
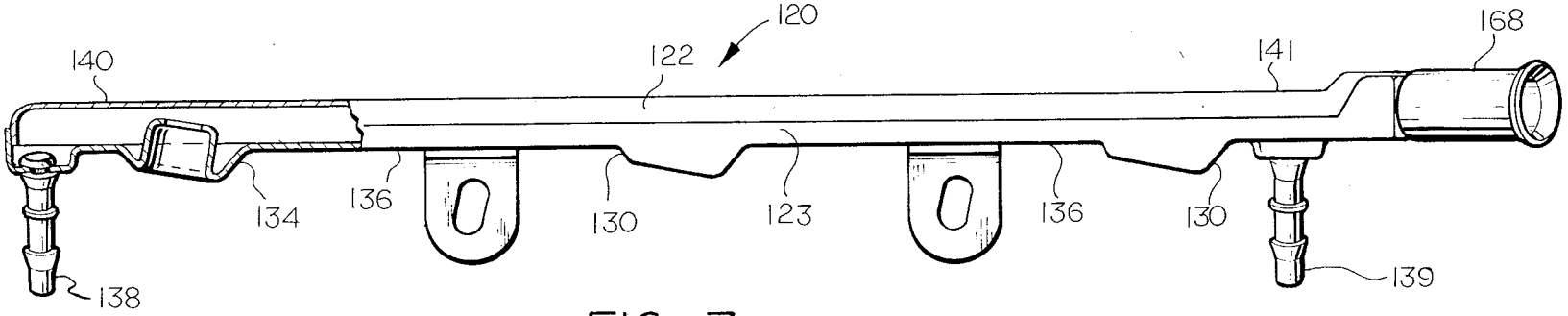
FIG. 7 is an outer side view of the other fuel rail assembly of the pair.
Figure 12:
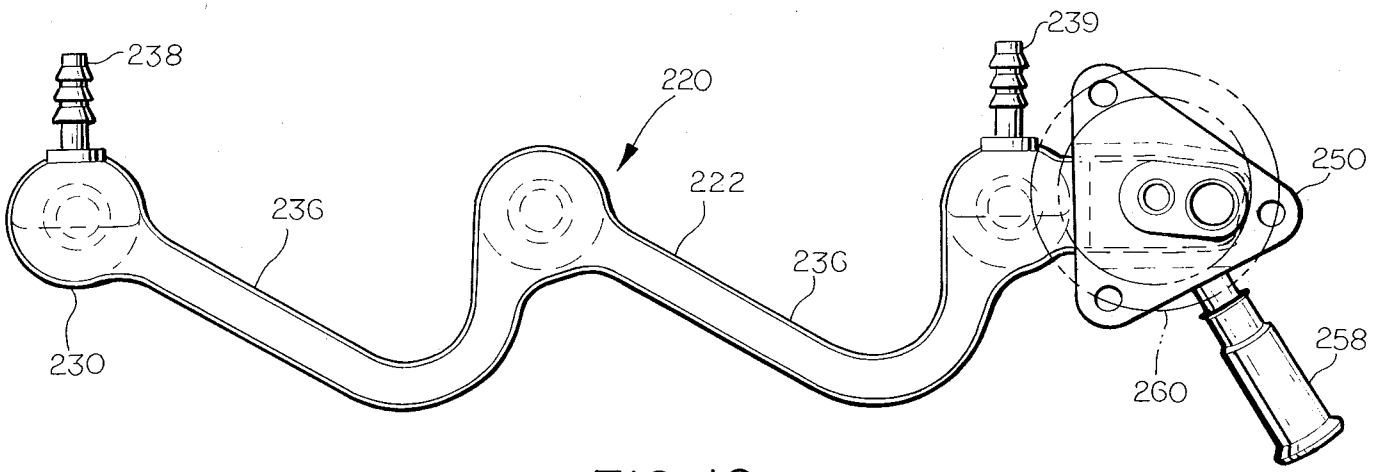
FIG. 12 is a plan view of FIG. 11.
Figure 11:
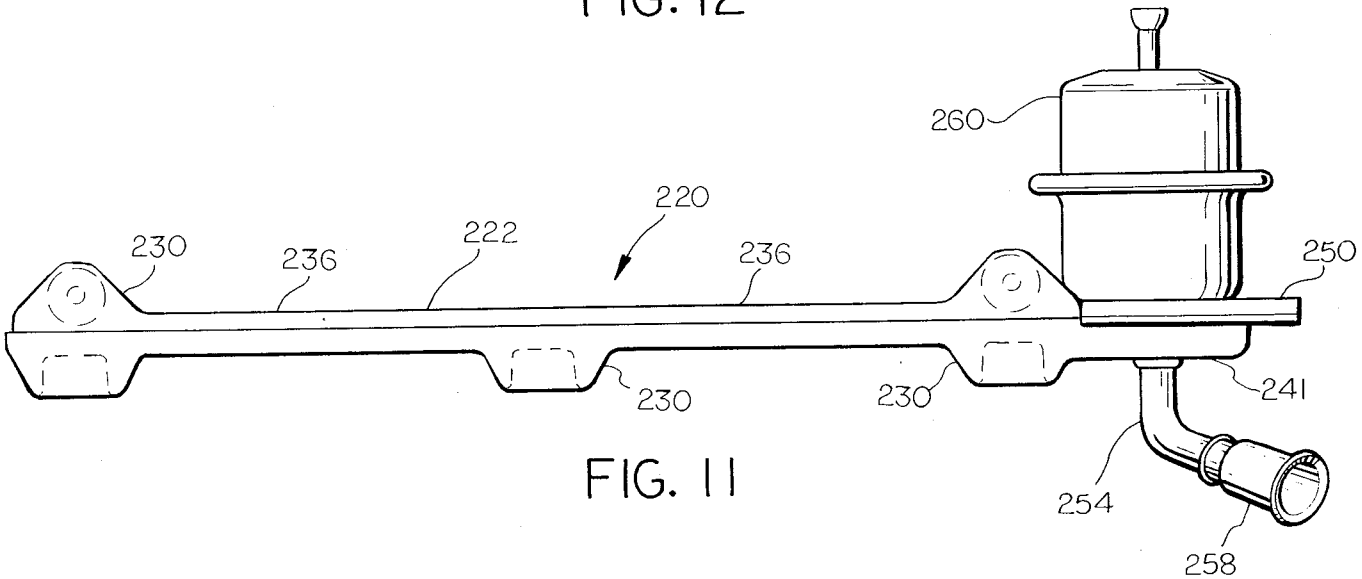
FIG. 11 is an outer side view of one of a pair of fuel rail assemblies of another V-6 engine embodiment.
Figure 14:
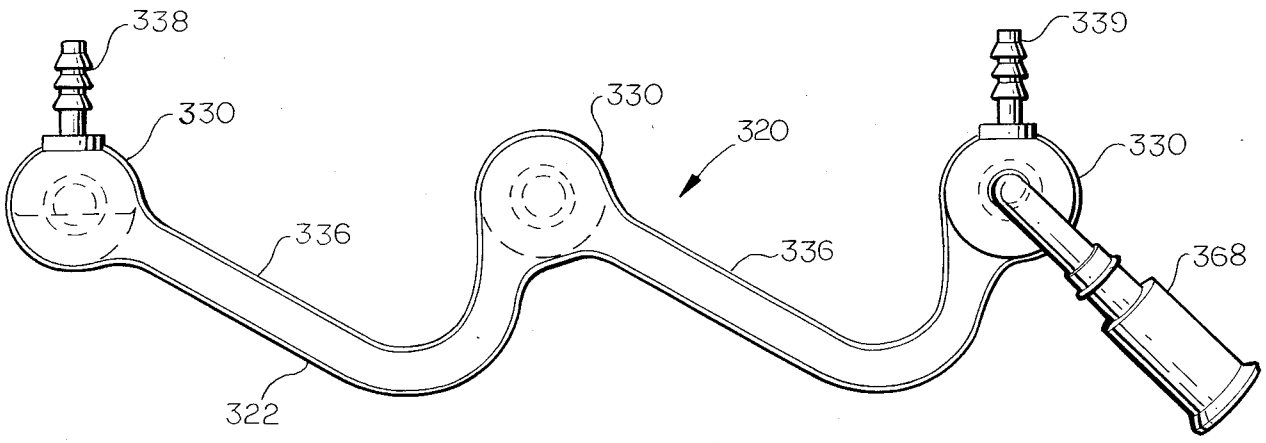
FIG. 14 is a plan view of FIG. 13.
Figure 13:
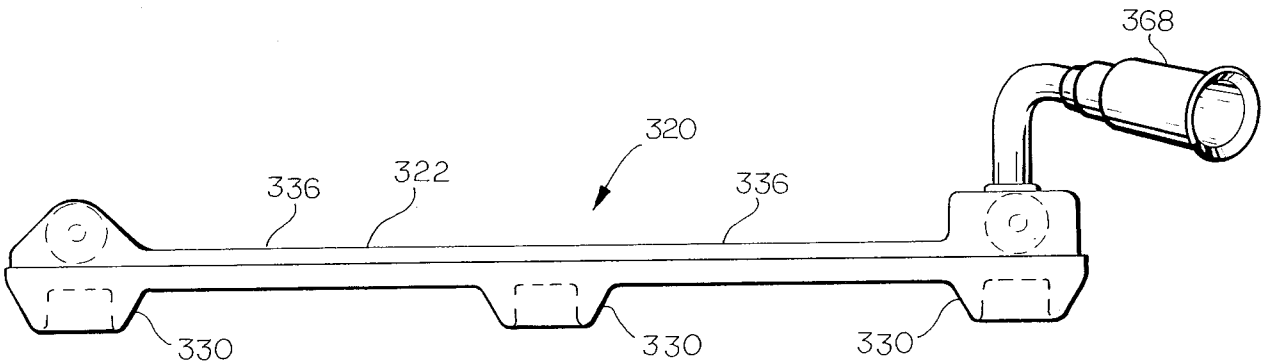
FIG. 13 is an outer side view of the other one of the pair of fuel rail assemblies.
Figure 15:
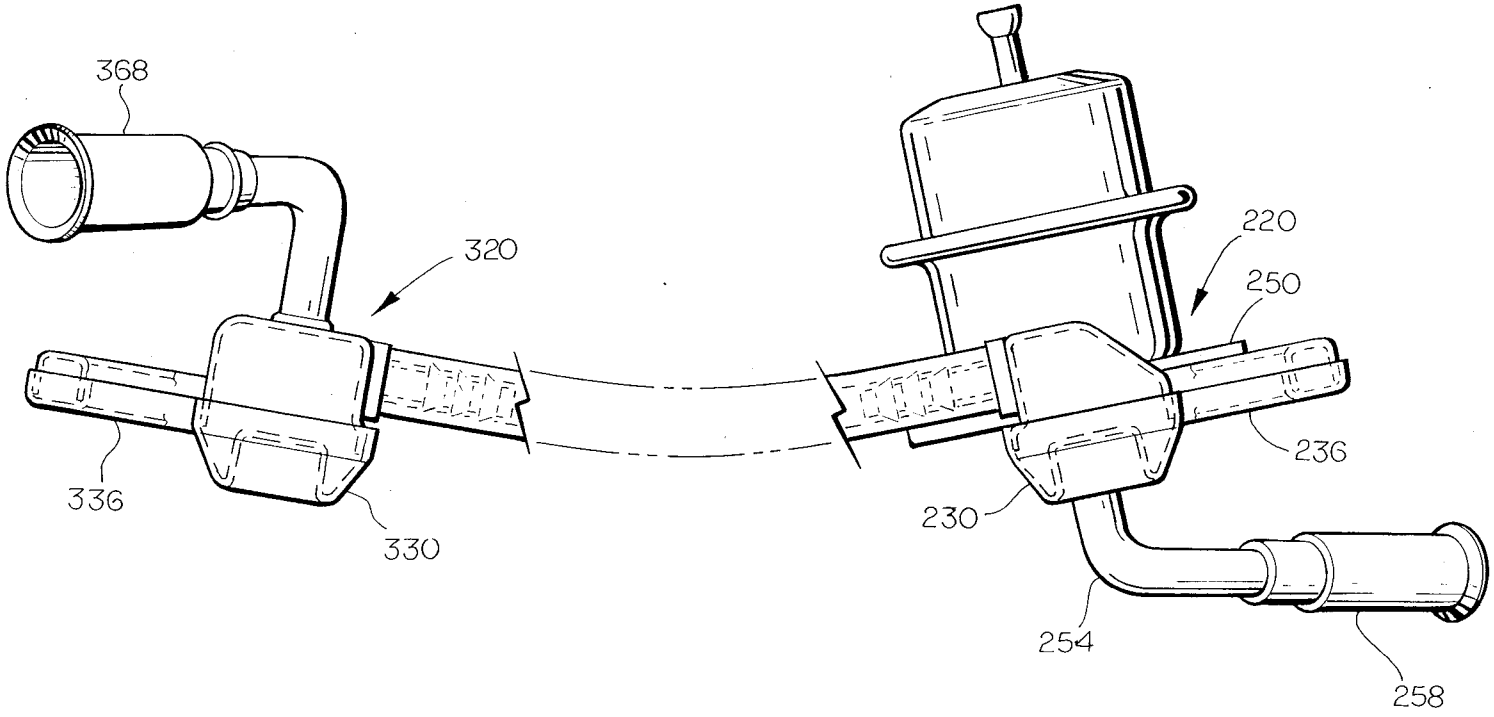
FIG. 15 is an end view of the pair of fuel rail assemblies connected together by crossover fuel hoses.

Fuel is supplied under pressure to the pair of fuel rail assemblies 20, 120 through a fuel line connector socket 168 affixed to the end of an angular leg 169 of stub end section 141 on rail 120 (see FIGS. 7–9). After flowing into fuel rail assembly 120 a portion of the fuel exits the assembly through crossover fuel line connectors 138,139 and travels through parallel crossover hoses to the crossover fuel line connectors 38, 39 where it enters fuel rail assembly 20. Excess fuel is returned to the supply system via the pressure regulator and return line 54 on fuel rail assembly 20.

The embodiment illustrated in FIGS. 11–15 also has a pair of fuel rail assemblies 220, 320 designed for use in tandem on a V-6 engine. They too have tubular fuel rail beams 222, 322 with spaced apart nodular sections 230, 330 connected in series by narrow fuel arteries or tube sections 236, 336. However the nodular sections are generally circular, when viewed in the plan view, rather than oblong as in the previously described embodiment and the connecting tube sections are arcuate rather than straight. The crossover hose connectors 238, 239, 338, 339 are mounted in domed sections formed in the tops of the nodular sections. Only one of the fuel rail beams 222 has a stub section 241 extending outwardly from one of its end nodules. The mounting plate 250 for the regulator 260 is affixed to the top of this stub section 241. The fuel return line 254 is foreshortened and terminates with a connector socket 258 disposed below the end of the stub section 241 (see FIG. 11). The fuel supply line is connected to the domed top portion of a nodular section located at the end of fuel rail beam 322 remote from the pressure regulator end of the adjoining rail beam 222. A connector 368 is provided on the distal end of a short fuel supply line elbow.

The fuel flow pattern in this embodiment differs from the prior embodiment in that the fuel return line connector is located at the same end of its fuel rail beam as the pressure regulator rather than adjacent to its other end. In both embodiments the fuel pressure regulator and the fuel supply line connector are located at opposite ends of the paired fuel rail assemblies. The portion of the fuel return line which doubles back along its respective fuel rail beam towards the opposite end thereof in the first embodiment is eliminated from the second embodiment wherein the return line connector is closely coupled to a short elbow section of line below the pressure regulator.

Although the invention has been described specifically with respect to two of its presently preferred embodiments, it is apparent that modifications could be made without departing from the scope of the invention as defined by the following claims.

What is claimed is:

1. A low profile fuel injection rail assembly comprising: an elongated fuel rail beam having a plurality of spaced apart nodular sections connected in series by narrow tubular sections, each of said nodular sections having interior wall surfaces which define a fuel sump chamber having a bottom end, tubular fuel injector socket members projecting into said sump chambers from said bottom ends, each of said socket members having an open bottom entrance end for holding a top portion of a fuel injector in fluid tight communication with said sump chamber, said nodular sections and said sockets being formed such that the lower interior wall surfaces of each of said nodular sections and the exterior wall surfaces of each of said sockets jointly define an annular well which extends below the adjacent outer bottom surface portions of said narrow tubular members, fitments for connecting the fuel rail beam to a fuel supply system, and a stub section extending longitudinally from at least one end nodular section of said series, said stub section having a cross sectional open interior area which is larger than that of said tubular section and smaller than that of said nodular sections, and said fuel system connector fitments are attached thereto.

2. A low profile fuel injection rail assembly according to claim 1 wherein said fitments are affixed to stub sections extending from nodular sections at opposite ends of said rail beam and said stub sections have cross sectional areas which are larger than those of said narrow tubular sections but smaller than those of said nodular sections.

3. A low profile fuel injection rail assembly according to claim 1 wherein at least the portions of the nodular sections which extend below the adjoining bottom surface portions of said narrow tubular sections have outside walls which converge in a downwardly direction and merge with said open entrance ends of their respective sockets.

4. A low profile fuel injection rail assembly according to claim 1 wherein said tubular socket members have partially closed top ends and cylindrical bodies with their axes canted towards one end of said beam.

5. A low profile fuel injection rail assembly according to claim 1 wherein said rail beam has a pressure regulator mounting plate affixed on the top side of a stub section extending from a nodular section at one end of said rail beam.

6. A low profile fuel injection rail assembly according to claim 1 wherein said rail beam has an elongated base member with upturned peripheral walls and a mating cover member with downturned peripheral walls, with the peripheral walls of one member overlapping the peripheral walls of the other member, said walls being bonded together to form a fluid tight peripheral seam.

7. A low profile fuel injection rail assembly according to claim 1 wherein said narrow tubular sections are arcuate longitudinally.

8. A low profile fuel injection rail assembly according to claim 1 wherein brackets for mounting said rail beam to an engine are affixed to said narrow tubular sections.

9. A low profile fuel injection rail assembly comprising: an elongated tubular fuel rail beam designed to have its longitudinal axis disposed substantially horizontal, said beam having a plurality of spaced apart nodular sections connected in series by tubular sections of reduced cross sectional area, said nodular sections each defining a fuel sump chamber having a hollow annular bottom portion which extends below the outside of the adjoining tubular section, a fuel injector socket recessed into the bottom of said fuel sump chamber, said socket having a tubular body, an open bottom entrance end and a partially closed top end providing fluid access to said fuel sump chamber, said hollow portion being defined by lower portions of the outside surface of said socket and the inside surface of said nodular section, fitments for connecting said fuel rail beam to a fuel supply system, and a stub section extending longitudinally from at least one end nodular section of said series, said stub section having a cross sectional open interior area which is larger than that of said tubular sections and smaller than that of said nodular sections, and said fuel system connector fitments are attached thereto.

10. A low profile fuel injection rail assembly according to claim 9 wherein at least the portions of the nodular section which extend below the outside of the adjoining tubular sections have outside walls which converge in a downwardly direction and merge with the bottom entrance ends of said sockets.

11. A low profile fuel injection rail assembly according to claim 9 wherein said fitments are affixed to opposite ends of said fuel rail beam.

12. A low profile fuel injection rail assembly according to claim 9 wherein a pressure regulator mounting plate is affixed to the top of said stub section.

13. A low profile fuel injection rail assembly according to claim 9 wherein said tubular sections are arcuate longitudinally.

14. A low profile fuel injection rail assembly according to claim 9 wherein said fuel rail beam has an elongated base member and an elongated cover member, said base and cover members being joined together by a peripheral seam which extends longitudinally around said beam.

15. A low profile fuel injection rail assembly comprising: a hollow fuel rail beam defined by an elongated base member, an elongated cover member, said base and cover members being joined together by a peripheral seam which extends longitudinally around said beam, said beam having a plurality of spaced apart nodular sections connected in series by tubular sections of reduced cross sectional size, said nodular sections each defining a fuel sump chamber, a cylindrical socket member recessed into the bottom of said chamber for holding a top portion of an electromagnetic fuel injector, said socket having an open bottom entrance end, a cylindrical side wall and apertured top end providing fluid access to said sump chamber, said nodular sections each having a hollow portion which surrounds the bottom end of its respective socket and extends below the outside of the adjacent connecting tubular section, fitments for connecting said fuel rail to a fuel supply system, and a stub section extending longitudinally from at least one end nodular section of said series, said stub section having a cross sectional open interior area which is larger than that of said tubular sections and smaller than that of said nodular sections, and said fuel system connector fitments are attached thereto.

16. A low profile fuel injection rail assembly according to claim 15 wherein the outside of said hollow portion which extends below the outside of the adjacent tubular section converges in a downwardly direction and merges with the entrance end of its respective socket.

* * * * *